United States Patent [19]

Peschke

[11] 4,108,352

[45] Aug. 22, 1978

[54] CONTINUOUS BUSINESS FORMS ASSEMBLY WITH ANTI-TENTING MEANS

[75] Inventor: Gordon C. Peschke, Mundelein, Ill.

[73] Assignee: Uarco Incorporated, Barrington, Ill.

[21] Appl. No.: 744,623

[22] Filed: Nov. 24, 1976

Related U.S. Application Data

[63] Continuation-in-part of Ser. No. 684,277, May 7, 1976, abandoned.

[51] Int. Cl.[2] ..... B65D 27/10

[52] U.S. Cl. ..... 229/69; 282/11.5 A

[58] Field of Search ..... 229/69, DIG. 4; 282/11.5 A, 11.5 R; 270/37, 53

[56] References Cited

U.S. PATENT DOCUMENTS

| | | | |
|---|---|---|---|
| 2,143,622 | 1/1939 | Fulk | 282/11.5 R |
| 2,246,234 | 6/1941 | Antrim | 282/11.5 A |
| 2,907,585 | 10/1959 | Sornberger et al. | 282/11.5 A |
| 3,104,799 | 9/1963 | Steidinger | 229/69 |
| 3,554,438 | 1/1971 | Von Malderghem | 229/69 |
| 3,967,776 | 7/1976 | Getsch | 229/69 |

FOREIGN PATENT DOCUMENTS

| | | | |
|---|---|---|---|
| 790,434 | 7/1968 | Canada | 229/69 |

*Primary Examiner*—Stephen P. Garbe

*Attorney, Agent, or Firm*—Wegner, Stellman, McCord, Wiles & Wood

[57] ABSTRACT

A continuous business forms assembly comprising a zig-zag folded stack of a multiplicity of superimposed, elongated plies of paper, including a plurality of intermediate plies. Each of the plies is provided with a longitudinally extending, control punch margin and the plies are held in assembled relation by longitudinally extending glue lines between adjacent plies adjacent the control punch margins. Individual form lengths in the assembly are defined by cross lines of weakening in the plies and the intermediate plies are completely severed in the area of at least the ones of the cross lines on which the assembly is folded and provided with reliefs thereat so that stresses caused by folding the assemblies into the stack are relieved to prevent tenting.

11 Claims, 8 Drawing Figures

CONTINUOUS BUSINESS FORMS ASSEMBLY WITH ANTI-TENTING MEANS

CROSS-REFERENCE

This application is a continuation-in-part of my commonly assigned application Ser. No. 684,277, filed May 7, 1976 now abandoned and entitled "Continuous Business Forms Assembly With Anti-Tenting Means."

BACKGROUND OF THE INVENTION

This invention relates to continuous business forms assemblies and, more specifically, to multiple-ply continuous business forms assemblies.

Prior art of possible relevance includes U.S. Letters Pat. No. 2,907,585 to Sornberger issued Oct. 6, 1959.

"Tenting" has long been a vexatious problem in the manufacture of multiple-ply, continuous business forms assemblies. Most typically, such assemblies are zig-zag folded in a stack at the end of the manufacturing process along transverse lines of weakening defining the individual forms in the assembly. The phenomena of tenting is so named, because when the stack is unfolded, at each fold line, a peaked structure will appear at the margin of the assembly where the various plies are positively secured together, as by glue, which structure somewhat crudely resembles a tent. A graphic illustration of such a "tent" appears in the drawings of the above-identified Sornberger patent.

Tents occur because the various plies of the assembly move longitudinally relative to each other at the time they are initially folded into the zig-zag stack for any of a variety of reasons and are due to the fact that while the distance between the transverse lines of weakening on each ply is the same, the outermost ply at each fold lies in a path having a greater length about the fold than the path in which an innermost ply resides. This difference in length is analogous to the difference in length about a race track between inner and outermost lanes thereon.

Typically, during manufacturing, the plies are secured together by glue which ultimately, positively holds the plies together. However, at the time of folding the assembly into the zig-zag stack, the glue will not have completely set up, allowing the relative movement causing the tent. Subsequently, the glue will set up, permanently incorporating the tent in the assembly.

Tents interfere with subsequent processing as, for example, printing on the forms in high speed equipment, such as tabulators, computer printers, or the like and may, in fact, cause such equipment to stop.

Tenting is aggravated by the number of plies in the assembly. Generally, through good manufacturing techniques, assemblies having four to six plies can be manufactured without tenting so extreme as to disrupt subsequent processing operations. However, when it is attempted to increase the number of plies over and above that amount, the tenting becomes so pronounced that commercially acceptable forms cannot be manufactured.

Over the years, the prior art has tried a number of approaches to eliminate or minimize the tenting problem. The structure disclosed by Sornberger is indicative of one approach. However, it will be appreciated merely from a cursory review of the Sornberger patent that extremely complicated cutting operations and gluing operations are required.

Theoretically, tenting could be eliminated in forms wherein so-called "cold" glues are employed if the assembly line was such as to allow complete drying of such glues prior to folding of the forms. As a practical matter, for most cold glues used in the business forms industry today, and at manufacturing speeds typically used, a drying area in an assembly line following a collator whereat the plies are assembled together would have to be so long as to be totally impractical.

It has also been proposed that faster drying or so-called "hot" glues be employed. This approach, while used to some extent, is not totally satisfactory for the reason that most such hot glues dry to a greater thickness the the cold glues, with the result that the forms of the resulting assembly are considerably thicker than might be desired in the glued marginal areas and are quite stiff and thus difficult to handle.

Thus, there is a real need for a simple, but effective, means for eliminating or minimizing tenting to eliminate difficulties in subsequent processing and/or the manufacture of multiple-ply, continuous business forms assemblies having a greater number of plies than can be manufactured according to present-day techniques.

SUMMARY OF THE INVENTION

It is the principal object of the invention to provide a new and improved multiple-ply, continuous business forms assembly. More specifically, it is an object of the invention to provide such an assembly which is relatively tent-free and therefore is easily processed on office forms handling equipment and which may be composed of an increased number of plies over present-day forms.

An exemplary embodiment of the invention achieves the foregoing object in a continuous business forms assembly comprised of a multiplicity of superimposed, elongated plies of paper, including at least one intermediate ply. The plies are held in assembled relation by longitudinally extending glue lines between adjacent plies and individual form lengths in the assembly are delimited by cross lines of weakening in the several plies. The intermediate plies are completely severed and have notches at at least some of the cross lines of weakening. The upper and lower plies are at least partially unsevered above the notches and are severed between the notches. Tent-causing stresses are relieved, precluding the formation of tents when the assembly is folded into a zig-zag stack at the conclusion of manufacture. Inasmuch as the upper and lower plies in the assembly are not completely severed, feeding of the form through office forms handling equipment is facilitated.

A preferred embodiment of the invention contemplates that each of the plies be provided with longitudinally extending control punch margins and that the longitudinally extending glue lines be adjacent the control margins. In order to maintain the control punch margins of the upper and lower plies continuous, the control punch margins of the upper and lower plies are made wider than the control punch margins of the intermediates plies so that a slit extending through all of the control punch margins to sever the intermediate plies need not completely sever the control punch margins of the upper and lower plies. Alternately, the edges of the control punch margins of the intermediate plies are provided with inwardly directed, wedge-shaped cutouts at the transverse lines of weakening to achieve the same result.

In one type of form made according to the invention, the intermediate plies are provided with die cuts which are centrally located and aligned with the lines of weakening and the severing of the intermediate plies extends from their edges to the die cuts.

In a preferred embodiment, the assembly is folded into a zig-zag stack on certain of the lines of weakening and the severing of the intermediate plies is made only at such lines of weakening to facilitate refolding of the form after handling by office processing equipment.

In a highly preferred embodiment of the invention, one of the notches is located at the intersection of the cross lines of weakening and a longitudinal line of weakening separating the control punch margins from the remainder of the associated plies. Such a notch is disposed only in the intermediate plies and severing is accomplished by slitting all plies with the slit extending just to the edges of the notch. As a consequence, the upper and lower plies are not completely severed to facilitate feeding.

Other objects and advantages will become apparent from the following specification taken in connection with the accompanying drawings.

DESCRIPTION OF THE PREFERRED EMBODIMENTS

Figure 1:
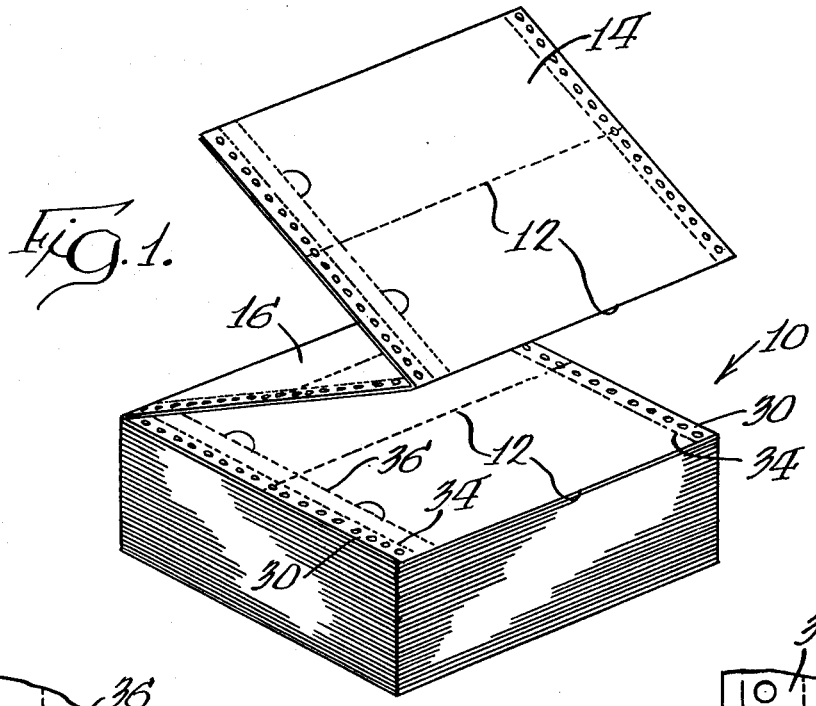
FIG. 1 is a perspective view of a continuous business forms assembly embodying the invention.

An exemplary embodiment of a multiple-ply, continuous business forms assembly made according to the invention is illustrated in the drawings as being of the type disclosed in the commonly assigned U.S. Letters Pat. No. 3,104,799 issued Sept. 24, 1963 to Steidinger. However, as will appear more fully hereinafter, it is to be understood that the usefulness of the invention is not limited to such forms and will find equal utility in other types of forms as, for example, the multiple-ply, continuous business forms assembly disclosed in the commonly assigned U.S. Letters Pat. No. 3,092,401 issued June 4, 1963 to Steidinger.

The multiple-ply, continuous business forms assembly is folded into a zig-zag stack, generally designated 10, along transverse lines of weakening 12 extending through the plies of the form. As illustrated, the assembly is folded on every other cross lines of weakening 12 but those skilled in the art will recognize that, depending upon form length, the assembly may be folded on every such line 12, every second line 12, or every third line 12, etc.

Figure 2:
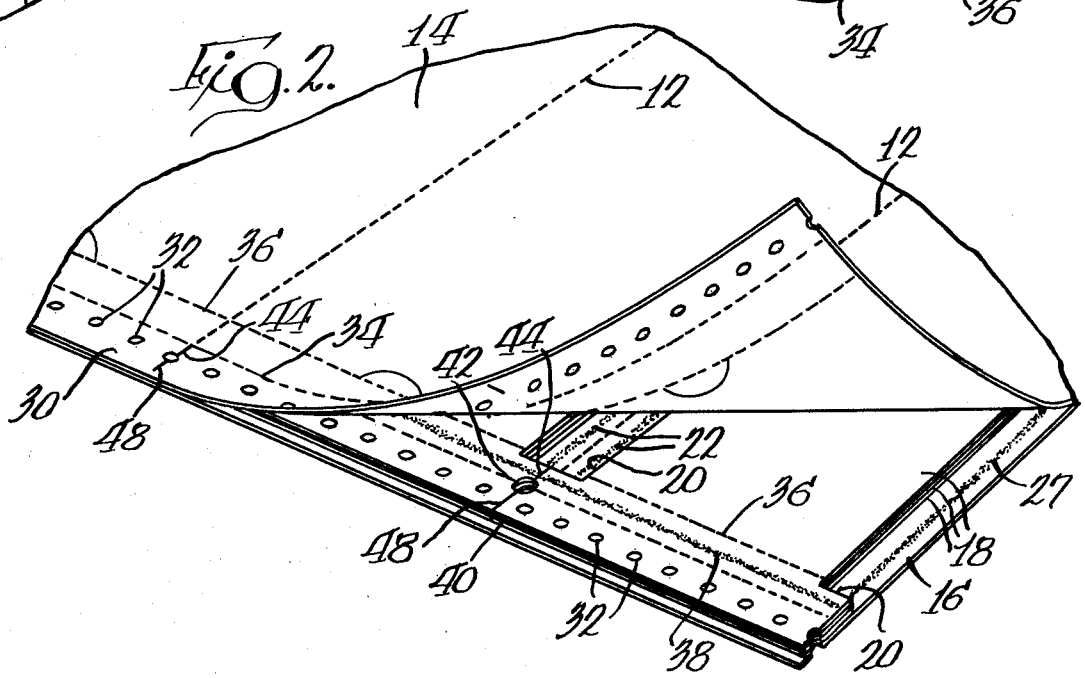
FIG. 2 is an enlarged, fragmentary perspective view of several form lengths of the assembly with the upper ply folded back to aid in understanding one construction of the invention.

As best seen in FIG. 2, the assembly includes an upper ply 14 and a lower ply 16 and plural intermediate plies 18. According to the invention, there may be twelve or more of the plies 14, 16 and 18. Each of the intermediate plies 18 is provided with a series of notches in the form of die cuts 20 centrally located in the panel in the manner disclosed in the first identified Steidinger patent. The die cuts 20 are aligned with the lines of weakening 12 and glue lines 22 extending transverse to the length of the assembly disposed on each side of each line of weakening 12 secure the upper and lower plies 14 and 16 together to partially define a stuffed, sealed envelope wherein the intermediate plies 18 are inserts and/or return envelopes.

Each of the longitudinally extending margins of the various plies is provided with a control punch margin 30 including a plurality of pin feed holes 32 by which the assembly may be fed through a computer-printer, a deleaver, or the like. Each control punch margin 30 is separated from the central portion of the associated ply by longitudinally extending lines of weakening 34 so that, after processing has been completed, the margins 30 may be removed.

One side of the assembly is provided with an additional longitudinal line of weakening 36 which is spaced inwardly of the line of weakening 34 and acts as a tear strip whereby the sealed envelopes may be opened and the insert material, or intermediate plies 18 removed. In the area between the lines of weakening 34 and 36, longitudinally extending glue lines 38 secure the plies together. Depending upon the particular type of form being manufactured, the lines 38 may appear on one or both sides of the assembly. Typically, the glue employed in the forming of the lines 38 will be a so-called "cold" glue for the reason that the same dries to form a thinner glue line than so-called "hot" glues and results in a less stiff form.

As mentioned previously, such glues, under current manufacturing techniques, cannot fully dry prior to the folding of the assembly into the zig-zag stack 10 and thus account for tenting in conventional forms.

According to the present invention, the tendency to tent is eliminated by completely severing the intermediate plies 18 at at least some of the cross lines of weakening 12 in the vicinity of the glue lines 38. In the case of assemblies, such as that illustrated in the drawings, the severing will be complete and generally extend from the edge of the intermediate plies through the control punch margins to intersect the end of the die cut 20.

Figure 3:
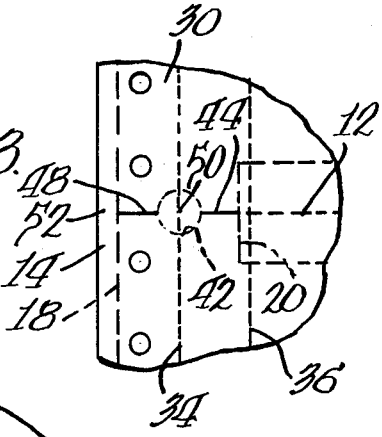
FIG. 3 is an enlarged, fragmentary plan view of portions of two adjacent form lengths in the assembly.

In the embodiment illustrated in FIGS. 1–3, such a slit is in part defined by notches in the form of an aperture 42 in the intermediate plies 18 only lying on the intersection of the longitudinal lines of weakening 34 and a corresponding cross line of weakening 12, a cut 44 extending through all plies to one end of the aperture 42 and to the end of the die cut 20, and a cut 48 extending through all plies and having a length so as to extend from an edge of the aperture 42 to the edge of the intermediate plies 18.

As a consequence of this construction, the intermediate plies 18 are completely severed at each such cross line of weakening 12 whereat the aforementioned structure is provided. At the same time, the upper and lower plies 14 and 16 remain continuous in their control punch margins 30, as illustrated by the lack of cuts at areas 50 and 52, as best illustrated in FIG. 3. As a result of such continuity, portions of the control punch margins 30 of the upper and lower plies 14 and 16 cannot fold upon themselves to provide tongues or the like which could interfere with processing of the forms on office equipment.

In forms of the type illustrated in the Figures, it is preferable that the severing be only at those cross lines of weakening 12 which are folded when the assembly is folded into a zig-zag stack. In other words, for forms of the type illustrated in FIG. 2, it is preferred that there be severing of the intermediate plies only at the cross lines 12 whereat the assembly is to be folded. Such a preferred construction has optimal refolding characteristics. Of course, where forms of the type illustrated in FIG. 2 are folded into a zig-zag stack on each cross line of weakening, then, of course, it is necessary that the severing structures be placed at each such cross line of weakening.

Figure 4:
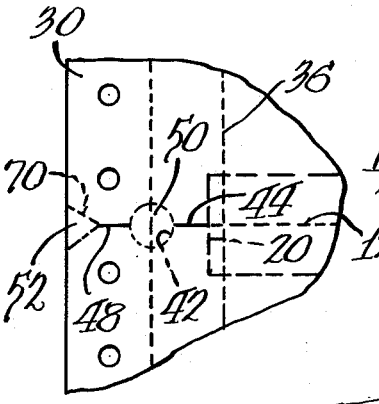
FIG. 4 is an enlarged, fragmentary plan view of a modified embodiment of the invention.

A modified embodiment is illustrated in FIG. 4 and structure identical to that in the embodiment illustrated in FIGS. 1–3 has been given like reference numerals.

In the embodiment of FIG. 4, the control punch margins 30 of the intermediate plies have the same width as the control punch margins of the upper and lower plies. However, at the transverse lines of weakening 12 whereat the assembly is to be folded into a zig-zag stack, the intermediate plies are provided with an inwardly directed, wedge-shaped notch or cutout 70. The cut 48 has a length to extend from the adjacent side of the aperture 42 to the apex of the cutout 70. Thus, the intermediate plies are completely severed by the cuts 44 and 48, the aperture 42, and the cutout 70. At the same time, the upper and lower plies remain joined in the areas 50 and 52 to ensure that the control punch margins of the upper and lower plies remain continuous to facilitate good feeding characteristics.

The complete severing of the intermediate plies at some of the cross lines of weakening minimizes or eliminates the stresses in the glued areas of the form caused by folding the same in a zig-zag stack, which stresses are responsible for tenting. The preferred structure employing the aperture 42 and two slits enables all plies to remain continuous through the collating process after which the slits 44 and 48 may be formed to completely sever the interior plies at the desired location without completely severing the control punch margin of the upper and lower plies to thereby assure good feeding characteristics in office equipment.

Figure 5:
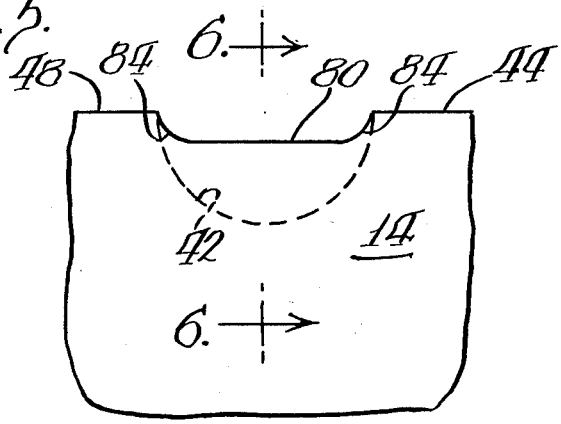
FIG. 5 is an enlarged plan view of a portion of the folded assembly.
Figure 6:
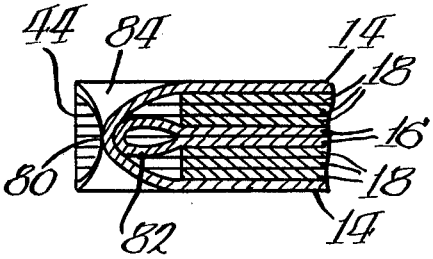
FIG. 6 is a sectional view taken approximately along the line 6—6 in FIG. 5.

FIGS. 5 and 6 illustrate the phenomena, in somewhat exaggerated fashion, by which tent-causing stresses are minimized. In particular, they illustrate the configuration of the parts at the notches and at the slit, and particularly, the configuration of the upper and lower plies 14 and 16 when the assembly is folded in the areas where such plies are continuous, that is, about the notches. For simplicity of illustration, the illustration shows the configuration at the notch or aperture 42 in the interior plies 18 rather than at the notches formed by the die cuts 20, since the former illustrates the severest case.

As illustrated in FIGS. 5 and 6, the upper ply 14 is continuous, that is, unsevered, in the area 80 which is about the aperture 42. As a consequence, the nose-like formation in the area 80, due to folding stresses, will collapse into the notch 42. The lower ply 16 has a similar continuous area 82 which is somewhat irregularly deformed within the aperture 42 by reason of compression forces applied thereagainst by the collapsing of the upper ply 14.

Of course, the configuration will be just the opposite of that illustrated at the folds on either side of that illustrated in FIGS. 5 and 6.

To some extent, adjacent the edges 84 of the continuous portion 80, the paper of which the ply 14 is formed will stretch, as illustrated.

It will be appreciated from a consideration of FIG. 6 that if the continuous portions 80 and 82 of the plies 14 and 16, respectiely, were severed at their midpoint and the plies straightened to a planar configuration, the ends resulting from such severing would fall in a plane encompassing the slits 44 and 48. Thus, it will be appreciated that the outermost ply of the fold does not travel a greater distance about the fold than the innermost ply when the form is made according to the invention. As a consequence, the cause of tenting is eliminated.

Figure 7:
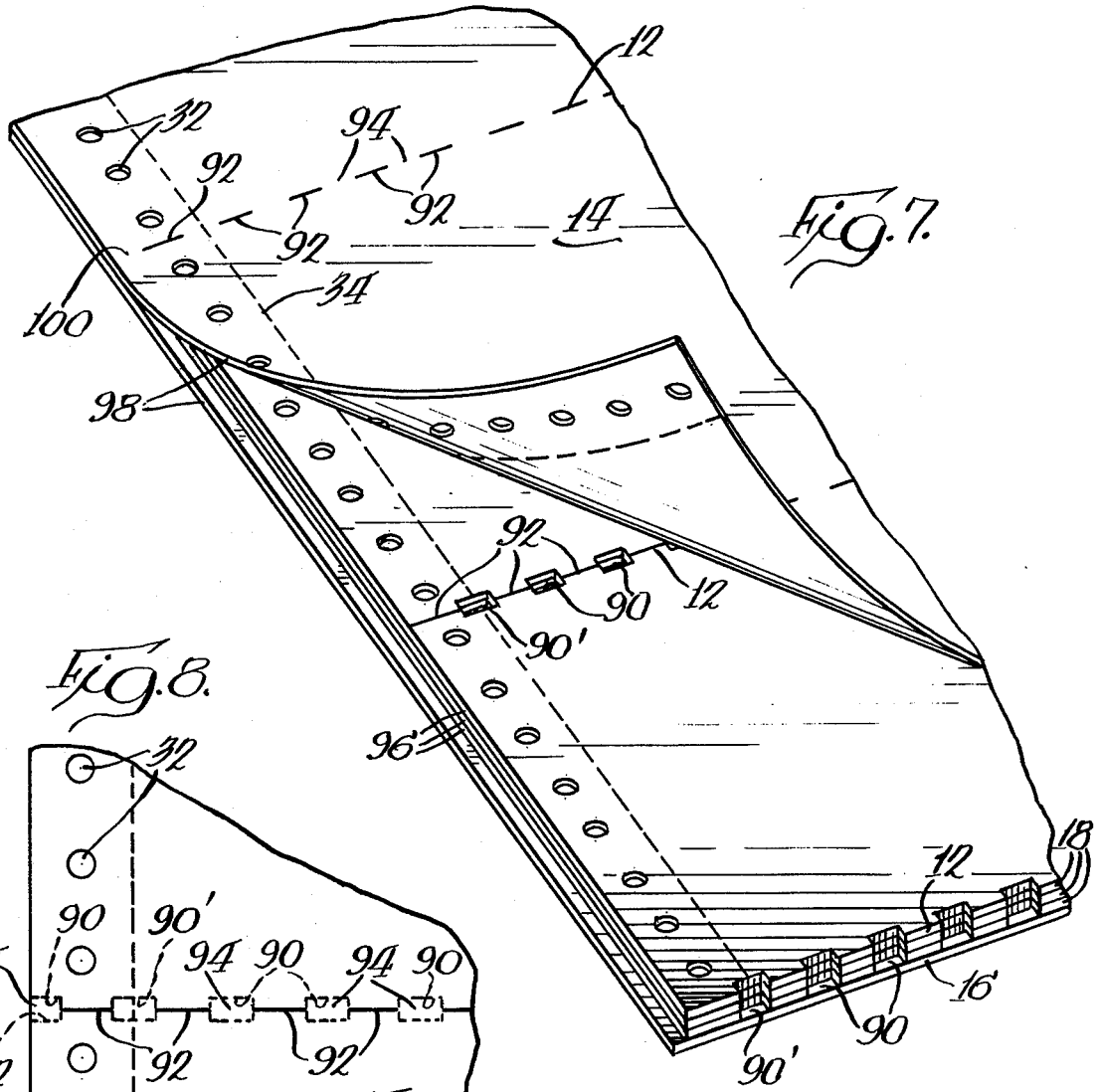
FIG. 7 is a perspective view of a further modified embodiment.
Figure 8:
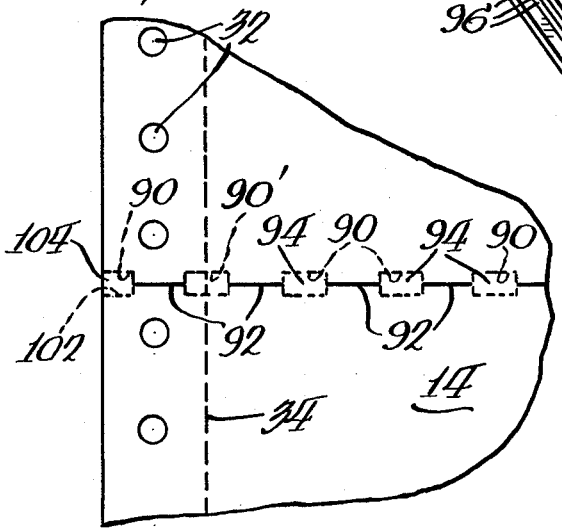
FIG. 8 is an enlarged, fragmentary plan view of an assembly similar to that shown in FIG. 7 but showing a further modification.

FIGS. 7 and 8 illustrate the application of the invention to continuous forms of the type disclosed in the second identified Steidinger patent. Where like elements are concerned, reference numerals identical to those used previously are employed.

At those lines of weakening 12 whereat the form is to be folded, a series of notches 90 extend through the intermediate plies 18 longitudinally on both sides of such fold line, as best seen in FIG. 8; and one notch 90' straddles the line of weakening 34 at each such line of weakening 12 whereat folding occurs. At the same time, slits 92 extend through all plies in the assembly between the notches 90 so as to completely sever the interior plies at the lines of weakening 12 upon which the assembly is to be folded. Areas 94 of both the plies 14 and 16 remain unsevered about the notches 90 so that the form remains continuous.

As a consequence of the foregoing, when folded at the lines of weakening 12 including the notches 90, a configuration very similar to that illustrated in FIG. 5 and 6 will be formed.

In the embodiment illustrated in FIG. 7, the marginal edges 96 of the intermediate plies 18 are located inwardly of the marginal edges 98 of the upper and lower plies 14 and 16, enabling the margins of the upper and lower plies 14 and 16 to be continuous, as illustrated at 100, at their outermost extremity in the same fashion as described in connection with the embodiment shown in FIGS. 2 and 3.

On the other hand, in the embodiment illustrated in FIG. 8, the marginal edges of all plies are in the same plane and an endmost one 102 of the notches 90 intersects the marginal edges of the intermediate plies 18 to again enable the marginal edges of the upper and lower plies 14 and 16 to be continuous in the area marked 104. Thus, the endmost one 102 of the notches 90 acts in the same fashion as the cutout 70 shown in the embodiment illustrated in FIG. 4.

The plies 14, 16 and 18 of the continuous forms shown in FIGS. 7 and 8 typically will be glued together by glue lines (not shown) in the manner disclosed by Steidinger in U.S. Pat. No. 3,092,401.

From the foregoing, it will be appreciated that a variety of geometric shapes can be employed in forming the notches. No limitation to any particular shape is intended, it merely being sufficient that the width of the notch, that is, its dimension extending longitudinally of the continuous form, be sufficient so as to enable the collapse of the continuous portions of the upper and lower plies to be received therein.

While the invention has been described in connection with single-width forms, those skilled in the art will readily appreciate its applicability to so-called "two-wide" forms.

The invention permits the fabrication of continuous business forms assemblies having a greater number of plies, without tenting, using cold glues which are liquid at room temperature whereby the frequently less desirable hot glues (glues in a solid state at room temperature) are not required.

The invention also permits an increase in the manufacturing speed over that used in the fabrication of assemblies by conventional techniques. Frequently, six-ply forms manufactured conventionally are run through the processing equipment at a linear speed that is only 65–70% of the linear speed at which three-ply forms are made, in part, to permit the glue to partially set to minimize tenting. Through the use of the anti-tenting structure of the invention, six-ply forms made according to the invention can be run through the manufacturing equipment at the same linear speed as conventional three-ply forms and some 40–50% or greater speeds than those employed in the manufacture of conventional six-ply forms.

Moreover, inasmuch as tenting difficulties in prior art forms have generally precluded the use of relatively heavy weights of paper, the present invention, through its elimination of the stresses causing tenting, permits more extensive use of such heavier paper weights in continuous forms assemblies.

A further benefit of the invention resides in the fact that forms made according to the invention, when zig-zag folded, lie flatter so that, for a shipping or storage container of a given size, all other things being equal, a greater number of form lengths made according to the present invention can be received therein than if the forms were made conventionally. Storage requirements are, accordingly, minimized and shipping labor reduced in that a given number of forms will occupy a lesser number of cartons and thereby reduce handling expense.

Thus, use of the invention not only eliminates tenting and the resultant problems in processing forms by the purchaser thereof, but allows the manufacture of forms with a greater number of plies and/or with heavier paper than can be made conventionally. The invention permits substantial increases in processing speeds, thereby producing a commensurate increase in production capacity and further decreases storage and/or shipping expense.

I claim:

1. A continuous business forms assembly comprising a zig-zag folded stack of a multiplicity of superimposed, elongated plies of paper, including upper and lower plies and a plurality of intermediate plies, each of said plies being provided with a longitudinally extending, control punch margin, said plies being held in assembled relation by longitudinally extending glue lines between adjacent plies adjacent said control punch margins, individual form lengths in the assembly being delimited by cross lines of weakening in the plies, all of the intermediate plies having notches and being completely severed across their widths at at least some of said cross lines of weakening, said upper and lower plies being at least partially unsevered about said notches and severed between said notches, so that stresses caused by folding said assemblies into said track are relieved to prevent tenting.

2. A continuous business forms assembly comprising a zig-zag folded stack of a multiplicity of superimposed, elongated plies of paper, including upper and lower plies and a plurality of intermediate plies, each of said plies being provided with a longitudinally extending, control punch margin, separated from the remainder of the ply by longitudinally extending lines of weakening, the upper and lower plies in said assembly having wider control punch margins than said intermediate plies, said plies being held in assembled relation by longitudinally extending glue lines between adjacent plies adjacent said control punch margins, individual form lengths in the assembly being delimited by cross lines of weakening in the plies, the intermediate plies being completely severed in the area of said longitudinally extending glue lines and said control punch margins at at least some of said cross lines of weakening by means including alternating slits and notches extending through the intermediate plies at said some cross lines of weakening and extending to the edges of said intermediate plies, said slits extending through said upper and lower plies and stopping short of the edges of said upper and lower plies so that said control punch margins on said upper and lower plies remain continuous to facilitate processing of said assembly whereby stresses caused by folding said assemblies into said stack are relieved to prevent tenting.

3. The continuous business forms assembly of claim 2 wherein one of said notches is at the intersection of said some cross lines of weakening and said longitudinally extending lines of weakening and said slits extend to said one notch and short of said longitudinally extending lines of weakening.

4. A continuous business forms assembly comprising a zig-zag folded stack of a multiplicity of superimposed, elongated plies of paper, including at least one intermediate ply having central die cuts extending across the assembly, each of said plies being provided with a longitudinally extending, control punch margin, said plies being held in assembled relation by longitudinally extending glue lines between adjacent plies adjacent said control punch margins, individual form lengths in the assembly being delimited by cross lines of weakening in the plies and aligned with said die cuts, at least one slit extending through said assembly so that the intermediate ply is completely severed across its control punch margin to said die cuts at at least some of said cross lines of weakening so that stresses caused by folding said assemblies into said stack are relieved to prevent tenting.

5. A series of stuffed envelopes comprising:

upper and lower elongated plies of paper defining the fronts and backs of envelopes in said series;

a plurality of intermediate, elongated plies of paper between said upper and lower plies and defining insert material within each envelope;

cross lines of weakening in said plies delimiting each envelope in the series;

die cuts in said intermediate plies aligned with said cross lines of weakening and extending across said intermediate plies and stopping short of at least one longitudinal margin thereof;

glue lines securing (a) said upper and lower plies to each other through said die cuts and (b) said intermediate and said upper and lower plies to each other along said one margin; and means extending to said die cuts completely severing said one margin of said intermediate plies at at least some of said cross lines of weakening, said severing means including at least one cut extending through said assembly, whereby tenting is eliminated, permitting the use of an increased number of intermediate plies, while allowing efficient subsequent processing of the series.

6. The series of stuffed envelopes of claim 5 wherein said severing means includes at least one notch in said one margin of said intermediate plies, and wherein said upper and lower plies are unsevered about said notch.

7. The series of stuffed envelopes of claim 5 wherein said series is folded into a zig-zag stack along only certain of said cross lines of weakening and said some cross lines of weakening are said certain lines of weakening whereby refolding said series in a zig-zag stack is facilitated.

8. A continuous business forms assembly comprising: a zig-zag folded stack of a multiplicity of superimposed, elongated plies of paper, including at least one intermediate ply, each of said plies being provided with a longitudinally extending, control punch margin, separated from the remainder of the ply by a longitudinally extending line of weakening, said plies being held in assembled relation by longitudinally extending glue lines between adjacent plies adjacent said control punch margins, individual form lengths in the assembly being delimited by cross lines of weakening in the plies, the intermediate ply being completely severed at at least some of said cross lines of weakening by means including slits extending through the assembly at said some cross lines of weakening and a cutout in the edges of said intermediate ply, said slits extending to said cutouts and short of the edges of said upper and lower plies so that said control punch margins on said upper and lower plies remain continuous to facilitate processing of said assembly whereby stresses caused by folding said assembly into said stack are relieved to prevent tenting.

9. The continuous business forms assembly of claim 8 wherein said cutouts are inwardly directed and wedge-shaped.

10. A continuous business forms assembly comprising a zig-zag folded stack of a multiplicity of superimposed, elongated plies of paper, including at least one intermediate ply, each of said plies being provided with a longitudinally extending, control punch margin, separated from the remainder of the ply by longitudinally extending lines of weakening, the upper and lower plies in said assembly having wider control punch margins than said intermediate ply, said plies being held in assembled relation by longitudinally extending glue lines between adjacent plies adjacent said control punch margins, individual form lengths in the assembly being delimited by cross lines of weakening in the plies, the intermediate ply being completely severed at at least some of said cross lines of weakening by means including slits extending through the assembly at said some cross lines of weakening and extending to the edges of said intermediate ply and short of the edges of said upper and lower plies so that said control punch margins on said upper and lower plies remain continuous to facilitate processing of said assembly whereby stresses caused by folding said assemblies into said stack are relieved to prevent tenting.

11. A continuous business forms assembly comprising a zig-zag folded stack of a multiplicity of superimposed, elongated plies of paper, including upper and lower plies and at least one intermediate ply, each of said plies being provided with a longitudinally extending, control punch margin, separated from the remainder of the ply by longitudinally extending lines of weakening, said plies being held in assembled relation by longitudinally extending glue lines between adjacent plies adjacent said control punch margins, individual form lengths in the assembly being delimited by cross lines of weakening in the plies, the intermediate ply being completely severed in the area of said longitudinally extending glue lines and said control punch margins at at least some of said cross lines of weakening by means including alternating slits and notches extending through the intermediate ply at said some cross lines of weakening and extending to the edges of said intermediate ply and short of the edges of said upper and lower plies, said slits further extending through said upper and lower plies, said upper and lower plies being unsevered about said notches to remain continuous to facilitate processing of said assembly whereby stresses caused by folding said assemblies into said stack are relieved to prevent tenting.

* * * * *